United States Patent [19]

Kuge et al.

[11] 4,109,289

[45] Aug. 22, 1978

[54] CORONA DISCHARGER

[75] Inventors: Tsukasa Kuge; Koichi Tanigawa, both of Tokyo, Japan

[73] Assignee: Canon Kabushiki Kaisha, Tokyo, Japan

[21] Appl. No.: 709,078

[22] Filed: Jul. 27, 1976

[30] Foreign Application Priority Data

Aug. 4, 1975 [JP] Japan ..... 50-94905

[51] Int. Cl.[2] ..... H01T 19/00

[52] U.S. Cl. ..... 361/230; 55/153

[58] Field of Search ..... 361/225, 229, 230; 55/153

[56] References Cited

U.S. PATENT DOCUMENTS 2,221,601 11/1940 Nielsen ..... 55/153 X

OTHER PUBLICATIONS

IBM Technical Disclosure Bulletin, vol. 14, No. 6, Nov. 1971, p. 1860.

*Primary Examiner*—Harry E. Moose, Jr.

*Attorney, Agent, or Firm*—Fitzpatrick, Cella, Harper & Scinto

[57] ABSTRACT

In a corona discharger having a corona discharge wire to which a voltage is applied to induce discharge, a member for absorbing vibration of the discharger is supported so as to make contact with the discharge wire at least during vibration thereof.

8 Claims, 16 Drawing Figures

CORONA DISCHARGER

BACKGROUND OF THE INVENTION

1. Field of the Invention

This invention generally relates to a corona discharger, and more particularly to an improved corona discharger having a thin conductor as an electrode for imparting corona discharge to an opposed member to be electrically charged or discharged, and having a vibration prevention member, wherein vibration of the corona discharge wire may be prevented, whether the voltage applied to the corona discharge wire is an AC or a DC voltage which contains a pulsating component, which vibration may otherwise take place with an amplitude several hundred times as great as the diameter of such discharge wire.

2. Description of the Prior Art

FIG. 1 of the accompanying drawings schematically shows the state of vibration of a corona discharge wire 1 as observed in the corona discharger of the prior art. For example, when an AC voltage of 7 KV is applied to a gold-plated tungsten wire having a length of 450 mm and a diameter of 60 $\mu$, the amplitude A of vibration of the wire will reach 2 to 4 mm. Such amplitude A can be reduced by increasing the tension of the tungsten wire but cannot be nullified. Although there is another method of holding the corona discharge wire by means of a shock absorber formed of foamed polyurethane or like material to prevent the vibration of the wire, this method still permits the corona discharge wire to vibrate with the portion thereof held down by the shock absorber acting as the node. Particularly, when the frequency of the AC voltage applied is increased, the vibration tends to become stronger and the mode of the vibration may sometimes change from standing wave to traveling wave.

SUMMARY OF THE INVENTION

It is therefore a primary object of the present invention to provide an improved corona discharger whose corona discharge wire may be prevented from vibrating.

It is another object of the present invention to provide an improved corona discharger in which vibration of the corona discharge wire may be absorbed by a member not secured to the corona discharge wire but disposed adjacent to the corona discharge wire in contact or non-contact therewith so as to make contact with the discharge wire at least during vibration thereof.

It is still another object of the present invention to provide an improved corona discharger whose corona discharge wire may be prevented from vibrating when the corona discharger is applied in an electrophotographic copying apparatus, whereby occurrence of non-uniform discharge, spark discharge or the like which would otherwise result from vibration of the corona discharge wire may be prevented to ensure stable corona discharge and accordingly clear electrostatic latent images to be provided.

Generally describing, the present invention provides a corona discharger having a corona discharge wire to which a voltage is applied to induce discharge and which is improved so that vibration of the corona discharge wire may be absorbed by a member not secured to the corona discharge wire but disposed adjacent to the corona discharge wire in contact or non-contact therewith so as to make contact with the discharge wire at least during vibration of the corona discharge wire.

The invention and other objects and features thereof will become more fully apparent from the following detailed description taken in conjunction with the accompanying drawings.

DESCRIPTION OF THE PREFERRED EMBODIMENTS

Figure 1:
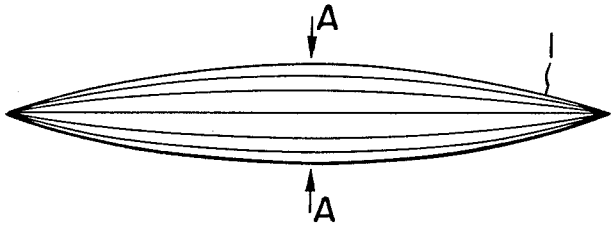
FIG. 1 schematically shows the state of vibration of the corona discharge wire taking place in a corona discharger of the prior art.
Figure 2:
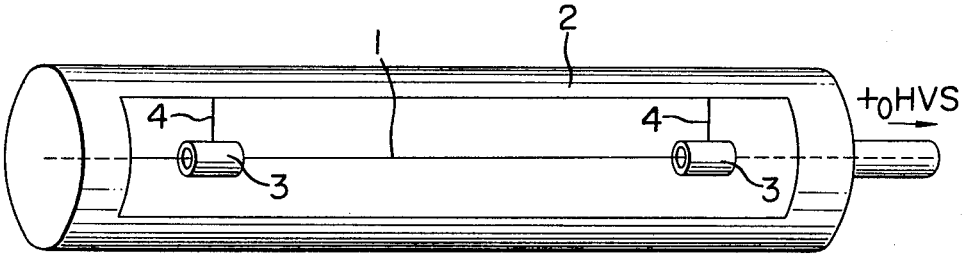
FIG. 2 is a sketch showing an example of the corona discharger embodying the present invention.
Figure 3A:
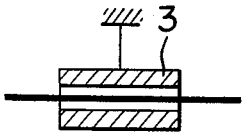
FIGS. 3*a*–3*d* are schematic views showing arrangements of the vibration preventing member according to the present invention.
Figure 3B:
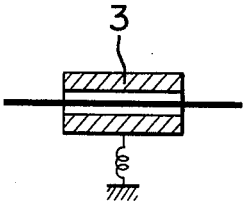
Figure 3C:
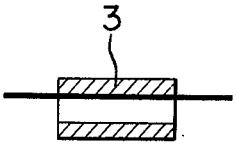
Figure 3D:
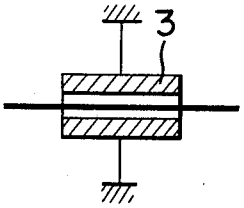

Referring to FIG. 2, there is shown an embodiment of the improved corona discharger. A corona discharge wire 1 is insulated from a shield 2 and connected to a high voltage source. Small cylindrical members 3 formed of ceramic are suspended from the shield 2 by threads 4, secured at one end to the shield, in such a manner that the inner walls of the small cylindrical member 3 are not in contact with the corona discharge wire 1 when no voltage is being applied to the corona discharge wire. Each of these small cylindrical members has a length of 15 mm, an inside diameter of 2 mm, an outside diameter of 4 mm and a weight of 3 g. The corona discharge wire has a length of 450 mm and a diameter of 60 $\mu$. The small cylindrical members may be formed of insulator or conductor materials.

When the corona discharge wire 1 begins to vibrate upon application of a voltage thereto, it makes contact with the inner wall of each of the small cylindrical members 3 so that the vibration energy of the discharge wire is transferred to the small cylindrical members, as a result of which the small cylindrical members are vibrated and thereafter, the vibration of the corona discharge wire 1 substantially disappears. This disappearance of the vibration may take place more effectively as the small cylindrical members are greater in length and weight. Too small a length or too light a weight of these members would cause them to vibrate with the corona discharge wire.

It is essential that the small cylindrical members themselves be somewhat movable also lengthwise of the corona discharge wire to prevent any fixed end from being created with respect to the vibration of the discharge wire.

Examples of the basic arrangement of small cylindrical members are shown in FIGS. 3(*a*) to (*d*), and in addition to these methods, combinations or derivatives thereof may also be adopted. The arrangement shown in FIG. 3(*a*) is by the method described in connection with FIG. 2; the arrangement shown in FIG. 3(*b*) is by the method of supporting the small cylindrical member against gravity by the use of a spring; the arrangement shown in FIG. 3(*c*) is by the method of supporting the small cylindrical member in contact with the corona discharge wire; and the arrangement shown in FIG. 3(*d*) is by the method of supporting the small cylindrical member in the upper and lower portions thereof.

Figure 4:
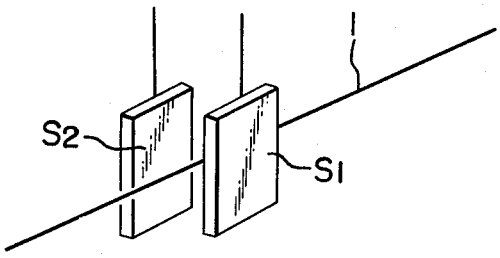
FIG. 4 is a sketch showing another arrangement of the vibration preventing member according to the present invention.
Figure 5A:
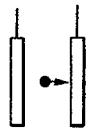
FIGS. 5*a*–5*g* schematically illustrate the principle on which the vibration of the corona discharge wire is absorbed.
Figure 5B:
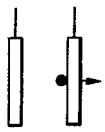
Figure 5C:
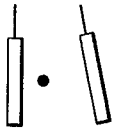
Figure 5D:
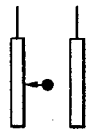
Figure 5E:
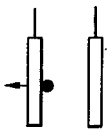
Figure 5F:
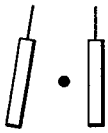
Figure 5G:
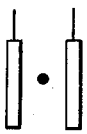

Depending on the discharge conditions, the vibration of the corona discharge wire often tends to be fixed in a predetermined direction. In such case, the shock absorbing member need not be a cylindrical member surrounding the entire circumference of the corona discharge wire but, as shown in FIG. 4, two planar members $S_1$ and $S_2$ may be opposedly disposed with the corona discharge wire 1 therebetween and in proximity to the wire 1; or alternatively, a single planar member $S_1$ may be disposed in proximity to the corona discharge wire. The manner in which the vibration is absorbed by such an arrangement is schematically shown in FIG. 5. As illustrated in FIG. 5(*a*) to (*g*), the planar members $S_1$ and $S_2$ move following the vibration of the corona discharge wire, and sufficient prevention of the vibration may be achieved by selecting the weight of the members $S_1$ and $S_2$ in accordance with the diameter, length and tension of the corona discharge wire and the voltage applied thereto.

The above-described principle of preventing the vibration may be considered to contain the following two factors.

A first factor is the phenomenon as shown in FIG. 5, wherein the vibrational energy of the corona discharge wire is eliminated by being absorbed by the environment of the corona discharge wire, namely, the vibration preventing members, as a result of which both the reflected wave and the standing wave from the fixed end come to disappear. It is essential, as already noted, that the vibration preventing members be movable also lengthwise of the corona discharge wire so as not to induce a fixed end.

Figure 6:
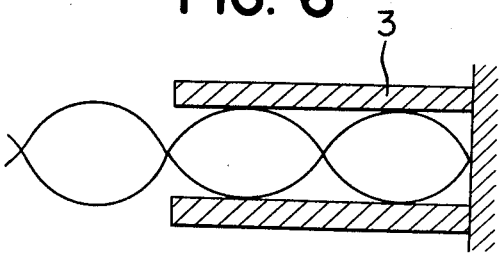
FIG. 6 is a schematic illustration of the principle on which the vibration of the corona discharge wire is restricted.

A second factor is the phenomenon as shown in FIG. 6, wherein if some vibration takes place, the amplitude of the vibration is restricted by the vibration preventing members.

Figure 7:
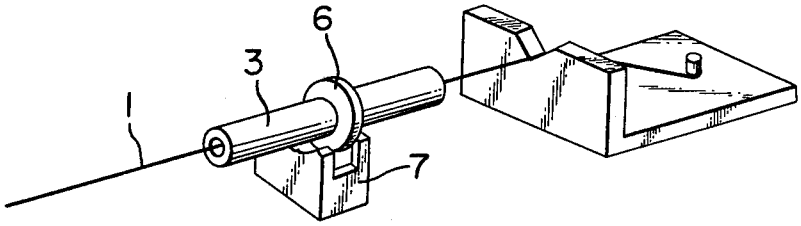
FIG. 7 is a sketch showing major portions of another embodiment.

Actually, the foregoing two phenomena appear in overlapped relationship, whereby the standing wave is absorbed to disappear or be restricted to a very small amplitude. FIG. 7 is a sketch showing major portions of another embodiment of the present invention which originates from the above-described principle. A flange 6 is integrally secured to the small cylindrical member 3 and a positioning member 7 is provided to restrict the range of movement of the small cylindrical member 3 in the direction parallel to the corona discharge wire 1 when vibration of the corona discharge wire takes place. The range of movement needs to be at least 1 mm for a length of 15 mm of the small cylindrical member.

It will thus be appreciated that the corona discharge electrode of the present invention is free of vibration and that a stable corona discharge may be accomplished.

What is claimed is:

1. In a corona discharger having a corona discharge wire to which a voltage is applied to induce discharge, the improvement comprising:
   - a member for absorbing vibration of the discharge wire, said member being disposed to make contact with the discharge wire at least during vibration thereof; and
   - a supporting member, independent of said discharge wire, for supporting said vibration absorbing member for movement in response to vibration of the discharge wire.

2. A corona discharger according to claim 1, wherein said vibration absorbing member comprises a cylindrical member encircling a portion of the corona discharge wire.

3. A corona discharger according to claim 2, wherein said cylindrical member has an outer flange portion, and wherein said supporting member supports said cylindrical member at the flange portion.

4. A corona discharger according to claim 1, wherein said supporting member is a thread for suspending said vibration absorbing member.

5. A corona discharger according to claim 1, wherein said supporting member is an elastic member.

6. A corona discharger according to claim 1, wherein said vibration absorbing member comprises a planar member.

7. A corona discharger according to claim 1, wherein said vibration absorbing member is disposed for contacting said discharge wire during vertical movement thereof.

8. A corona discharger according to claim 1, wherein at least two supporting members are provided at upper and lower sides, respectively, of said discharge wire.

* * * * *